US011274473B2

(12) United States Patent
Jevens

(10) Patent No.: US 11,274,473 B2
(45) Date of Patent: Mar. 15, 2022

(54) SECURITY TAG

(71) Applicant: Jevens Design Limited t/a The Hanger Company, Dundalk (IE)

(72) Inventor: Paul Jevens, Dundalk (IE)

(73) Assignee: JEVENS DESIGN LIMITED T/A THE HANGER COMPANY, Dundalk (IE)

( * ) Notice: Subject to any disclaimer, the term of this patent is extended or adjusted under 35 U.S.C. 154(b) by 168 days.

(21) Appl. No.: 16/622,288

(22) PCT Filed: Jun. 13, 2018

(86) PCT No.: PCT/EP2018/065625
§ 371 (c)(1),
(2) Date: Dec. 12, 2019

(87) PCT Pub. No.: WO2018/229106
PCT Pub. Date: Dec. 20, 2018

(65) Prior Publication Data

US 2020/0149323 A1 May 14, 2020

(30) Foreign Application Priority Data

Jun. 13, 2017 (IE) ..... 2017/0128

(51) Int. Cl.

| | |
|---|---|
| ***G09F 3/16*** | (2006.01) |
| ***E05B 73/00*** | (2006.01) |
| ***G09F 3/03*** | (2006.01) |
| *G09F 3/02* | (2006.01) |

(52) U.S. Cl.
CPC ..... *E05B 73/0017* (2013.01); *G09F 3/0323* (2013.01); *G09F 3/16* (2013.01); *G09F 2003/0282* (2013.01)

(58) Field of Classification Search
CPC ..... E05B 73/0017; G09F 3/0323; G09F 3/16; G09F 2003/0282
See application file for complete search history.

(56) References Cited

U.S. PATENT DOCUMENTS 2,246,572 A * 6/1941 Canter ..... G09F 3/0323 292/325
3,724,890 A * 4/1973 Adamson ..... G09F 3/0323 292/322
4,299,870 A * 11/1981 Humble ..... E05B 73/0017 24/704.2

(Continued)

FOREIGN PATENT DOCUMENTS

GB 2 112 731 7/1983
WO WO 1998/034204 8/1998

(Continued)

*Primary Examiner* — Gary C Hoge
(74) *Attorney, Agent, or Firm* — LaMorte & Associats P.C.

(57) ABSTRACT

A security tag (100) for attachment to an item comprises a pair of flat panels (102, 104) joined together by a flexible hinge (106). Each panel (103, 104) has an inner surface and an outer surface. The panels are foldable about the flexible hinge with the inner surfaces of the panels abutting each other. One panel has a retainer (112) for a flexible tie of plastics material and the other panel has an orifice (116) in alignment with the retainer (112). The security tag (100) can only be removed by breaking the plastics tie.

19 Claims, 4 Drawing Sheets

(56) References Cited

U.S. PATENT DOCUMENTS

| | | | | |
|---|---|---|---|---|
| 4,811,977 | A * | 3/1989 | Swift | G09F 3/0311 156/268 |
| 5,440,295 | A * | 8/1995 | Ciecwisz | E05B 73/0017 340/573.4 |
| 5,839,169 | A | 11/1998 | Edwards et al. | |
| 6,116,666 | A * | 9/2000 | Adamson | G09F 3/0311 24/543 |
| 7,808,386 | B1 * | 10/2010 | Sayegh | E05B 73/0017 340/572.1 |
| 8,573,011 | B2 * | 11/2013 | Thoonsen | E05B 73/0017 70/57.1 |
| 2002/0129472 | A1 * | 9/2002 | Copen | E05B 73/0017 24/704.1 |
| 2010/0126238 | A1 * | 5/2010 | Mazzucchelli | E05B 73/0035 70/58 |
| 2014/0237775 | A1 * | 8/2014 | de Lima Castro | G09F 3/037 24/16 PB |
| 2015/0161863 | A1 * | 6/2015 | Yang | G08B 13/2434 340/572.8 |
| 2017/0140677 | A1 * | 5/2017 | Ibanez Fernandez De Lis | D06F 95/008 |
| 2017/0221389 | A1 * | 8/2017 | Petru | B65D 67/02 |

FOREIGN PATENT DOCUMENTS

| | | |
|---|---|---|
| WO | WO 2007/129189 | 11/2007 |
| WO | WO 2015/008061 | 1/2015 |

* cited by examiner

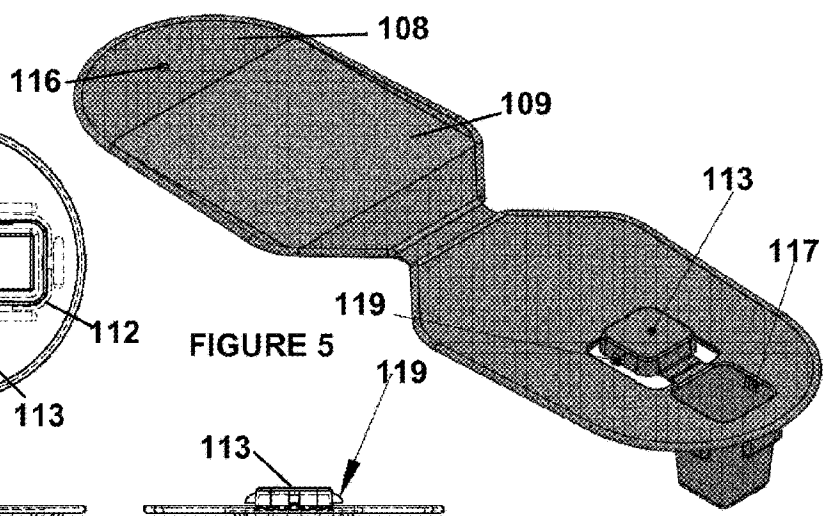
FIGURE 1
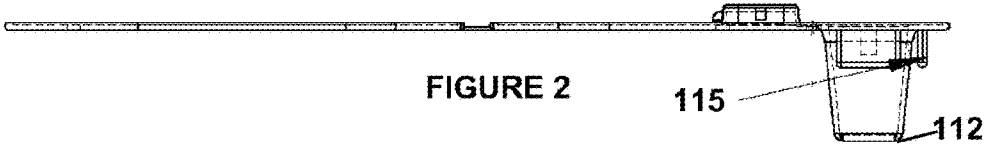
FIGURE 2
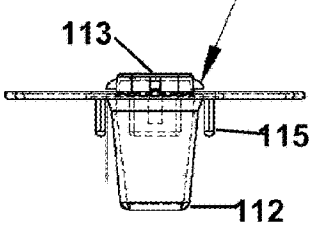
FIGURE 3
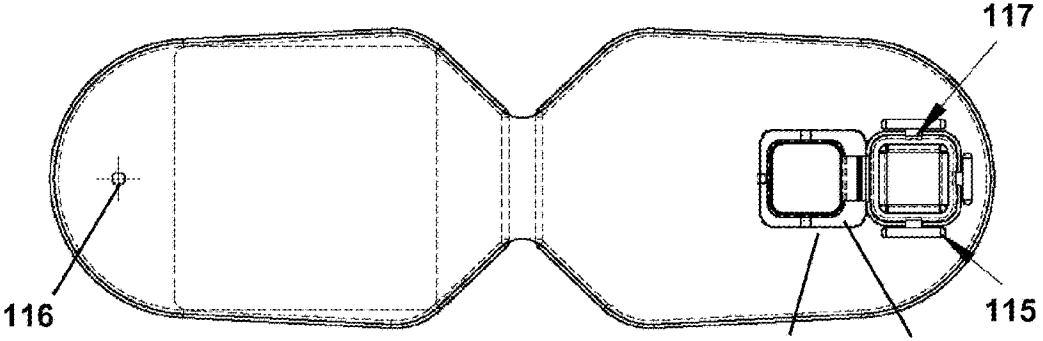
FIGURE 4
FIGURE 5
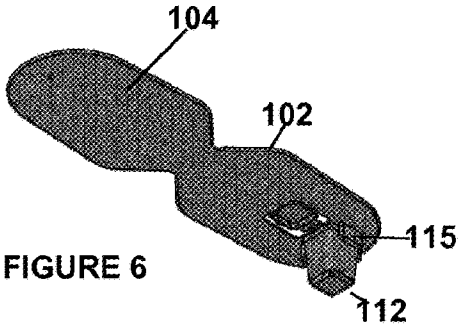
FIGURE 6

SECURITY TAG

The present invention relates to a security tag, particularly to a security tag which can be attached to garments, items of clothing, handbags, shoes, sunglasses and other items of merchandise.

There is a major need for an improved security tag which can be used not only in shops, stores and other retail premises but can also be attached to items purchased over the internet and delivered by mail or other delivery services to a customer. Such purchases can be returned by customers if they are not the correct size, if they are not to their liking or if the customer is not satisfied with the product. The difficulty with such returns, is that the potential customers can use the item or wear it before they decide to return it, thereby diminishing its resale value. Such a practice is known in the industry as "wardrobing".

The object of the invention is to alleviate the problems associated with current security tags and to provide an effective security tag, particularly though not exclusively, for internet or mail order purchases.

The present invention provides a security tag for attachment to an item comprising a pair of flat panels, namely a first panel and a second panel, each panel having an inner surface and an outer surface, with the inner surfaces of the panels adapted to abut each other, with the first panel having a retainer for a flexible tie of plastics material and the second panel having an orifice in alignment with the retainer, whereby the security tag can only be removed by breaking the plastics tie.

Advantageously, the first and second flat panels are connected together at one edge by a flexible hinge to enable the flat panels to overlie one another.

The breakable plastics tie may be a narrow cross-section tie insertable into a garment using a needle applicator tagging gun. Such breakable plastics ties are commonly known as "Dennison tags".

Ideally, the plastics tie is manufactured from a bright or a unique non-standard colour or shape not normally used in the retail industry. Therefore even if the customer has a needle applicator tagging gun they will not have access to the non-standard ties of the invention.

Alternatively, the breakable plastics tie is pivotably attached to the second panel and is engagable with the retainer in the first panel.

Conveniently, the retainer has a pair of security tabs at the side which prevent access to its interior and the retainer is in the form of a receptacle or a chamber for securely accommodating one end of the flexible tie.

The present invention also includes a specific elongate flexible tie having at one end a flexible cross bar and at the other end a rigid anchor element larger than the flexible cross bar element.

The invention will hereinafter be more particularly described with reference to the accompanying drawings, which show by way of example, three embodiments of a security tag according to the invention and a specific example of a flexible tie for use with the first and third embodiments. In the drawings:

FIG. 1 is a plan view of the inner surfaces of a first embodiment of security tag according to the invention;

FIG. 2 is a side view of the first embodiment of security tag;

FIG. 3 is an end view of the first embodiment of security tag;

FIG. 4 is a plan view of the outer surfaces of the first embodiment of security tag;

FIG. 5 is a perspective view from above of the inner surfaces of the first embodiment of security tag;

FIG. 6 is a perspective view from below of the outer surfaces of the first embodiment of security tag;

Figure 10:
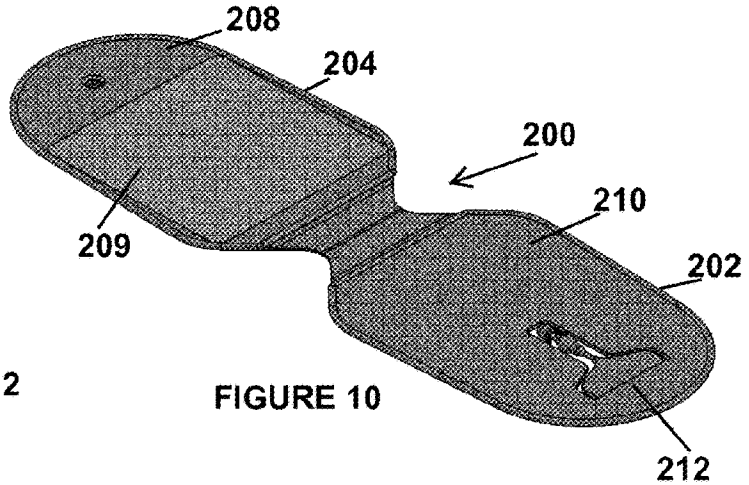
FIG. 10 is a perspective view of the inner surfaces of the second embodiment of security tag.

Referring to the drawings and initially to FIGS. 1 to 6, the first embodiment of security tag 100 comprises two flat panels 102 and 104 joined together by a hinge 106 about which they can be folded to overlap one another with the inner surfaces 108 and 110 respectively contacting the upper and lower surfaces of a garment (not shown).

On the inner surface of 108 is a panel 109 for receiving an RS adhesive security label (not shown) which would not be visible when the panels 102 and 104 are folded over. On the flat panel 102, is a receptacle or chamber 112 which can be closed over by a lid 113. An orifice 116 on the panel 104 aligns up with the receptacle or chamber 112 and lid 113. Side holes 117 are provided on the receptacle or chamber 112 and complementary tabs 119 are provided on the lid 113. Security tabs 115 prevent access to the receptacle or chamber 112 by a toothpick or the like. In order to attach the security tag to an item of clothing, a breakable tie of plastics materials (not shown) well known in trade as a "Dennison tag" is inserted through the orifice 116 using the well known needle applicator Dennison tagging gun with one end of the tie lying in a protected zone within the receptacle or chamber 112 preventing access to that end, the tie end being held being inserted through a hole formed in the lid 113 by a needle applicator. The tie will be manufactured in non-standard colours such as bright pink, green, yellow or other non-standard colours. In this way, if a customer breaks the tie and replaces it with a standard tie, it will be immediately apparent that the security tag has been tampered with. Also when the security tag is attached to an item of clothing in a shop, the RS adhesive security label fixed to the panel 109 cannot be accessed without first breaking the plastics tie securing the two panels 102 and 104 together.

Figure 11:
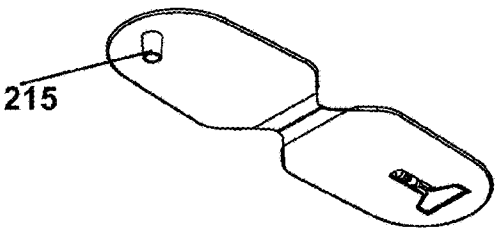
FIG. 11 is a perspective view of the outer surfaces of the security tag.
Figure 9:
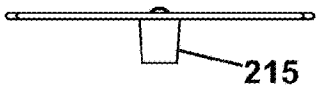
FIG. 9 is an end view of the second embodiment of security tag.
Figure 7:
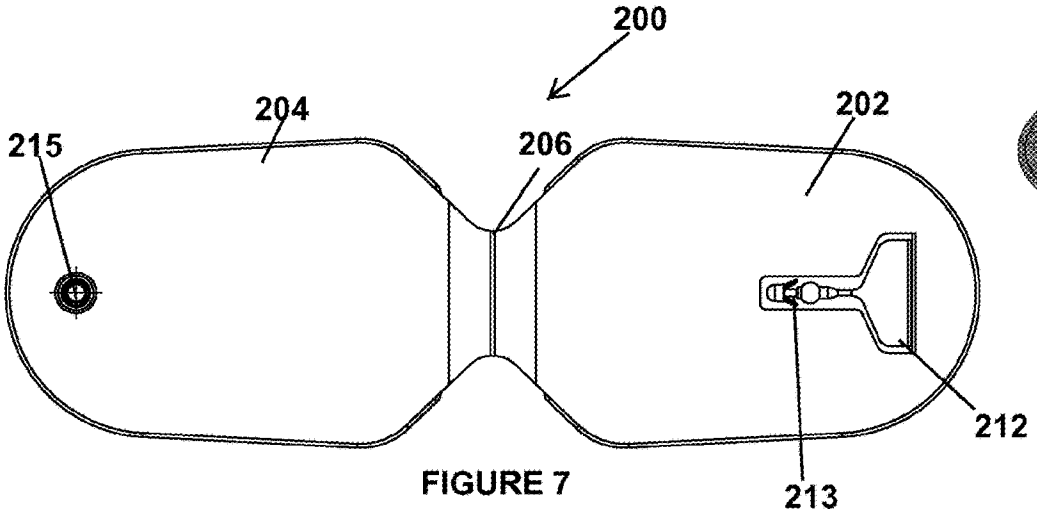
FIG. 7 is a plan view of the outer surfaces of the second embodiment of security tag according to the invention.
Figure 8:
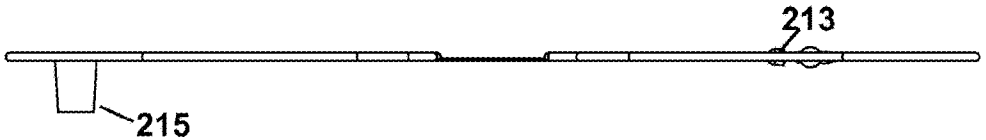
FIG. 8 is a side view of the second embodiment of security tag according to the invention.

Referring now to FIGS. 7 to 11, the second embodiment of security tag 200 comprises two flat panels 202 and 204 joined together by a hinge 206 about which they can be folded to overlap one another with the inner surfaces 208 and 210 respectively contacting one another.

On the inner surface 208 is a panel 209 for receiving an RS adhesive security label (not shown) which would not be visible when the panels 202 and 204 are folded over. On the flat panel 202, is a pivotable securing element 212, the barbed end 212 of which can be inserted into a hollow receiver 215 on the panel 204 which aligns up with the barbed end 213 when the panels 202 and 204 are folded over.

In order to attach the security tag to an item of merchandise such as a bag, shoe, sunglasses or the like, the breakable securing element 212 of plastics material is inserted into the hollow receiver 215 preventing access to the barbed end 213. In this way if a customer breaks the securing element 212 to remove the security tag from the item of merchandise it will be immediately apparent that the security tag has been tampered with. Also when the security tag is attached to an item of merchandise in a shop, the RS adhesive security label fixed to the panel 209 cannot be accessed without first breaking the securing element 212 securing the two panels 202 and 204 together.

Figure 16:
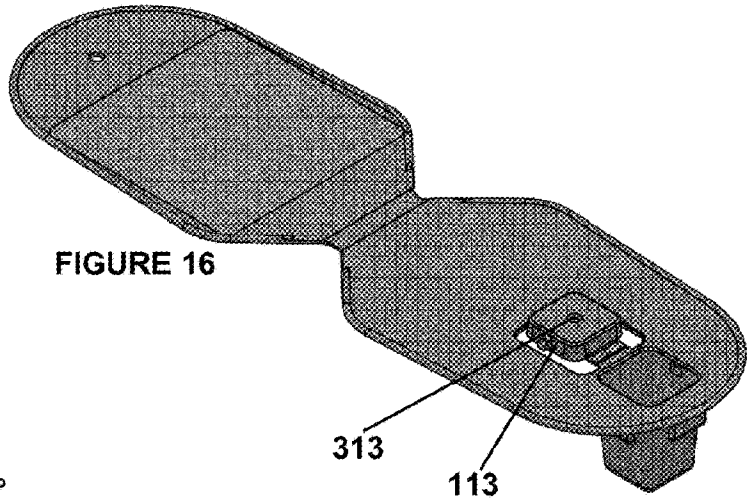
FIG. 16 is a perspective view of the third embodiment.
Figure 15:
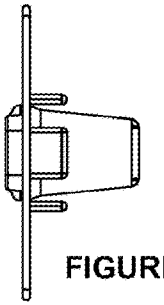
FIG. 15 is an end view of third embodiment.
Figure 14:
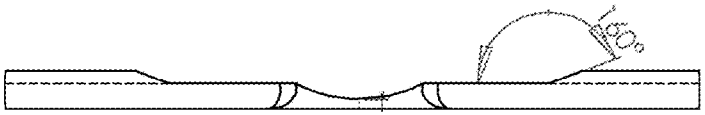
FIG. 14 is an enlarged view of the hinge detail marked as A on FIG. 13.
Figure 13:
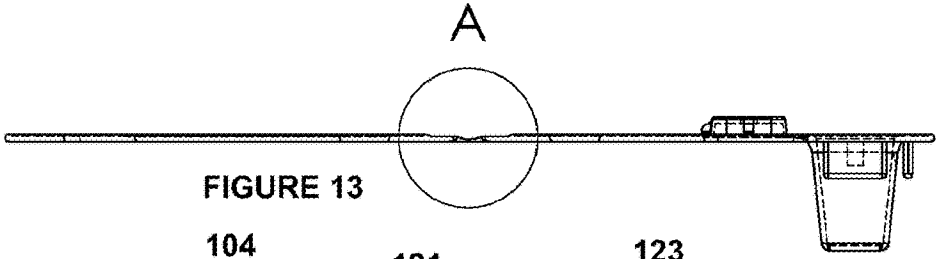
FIG. 13 is a side view of the third embodiment.
Figure 12:
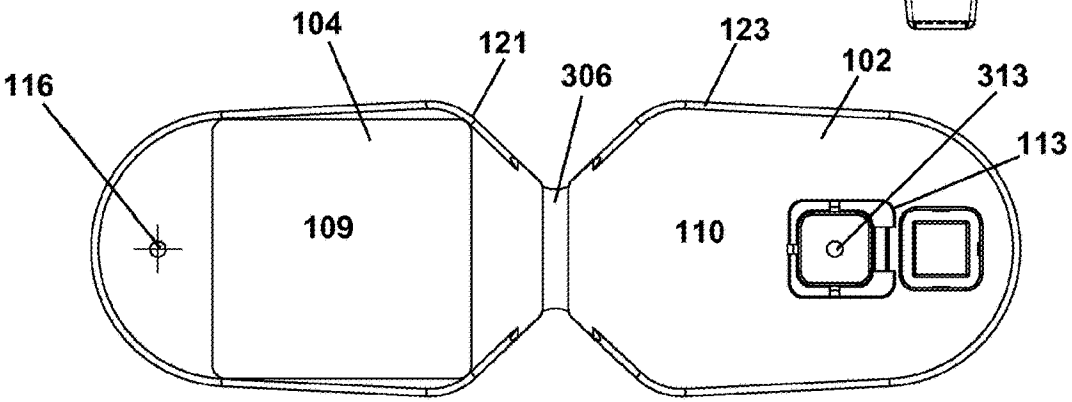
FIG. 12 is a plan view of a third embodiment of security tag according to the invention.

Referring to FIGS. 12 to 16, as the third embodiment is very similar to the first embodiment like numerals will be used for like parts. The only features which need specific mention are the parts which differ from the first embodiment.

The hinge 306 is attached directly to the panels 102 and 104 without the presence of the ridges 105 and 107 in the first embodiment and the ribs 121 and 123 at the hinge panel. This facilitates the functions of the hinge and also facilitates the two panels overlying one another. Also a hole 313 is preformed on the lid 113 which facilitates the threading through of the flexible tie.

Figure 23:
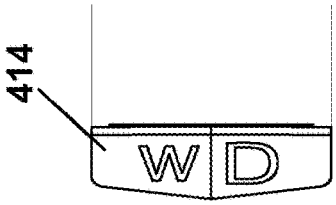
FIG. 23 is a second end view of the flexible tie.
Figure 17:
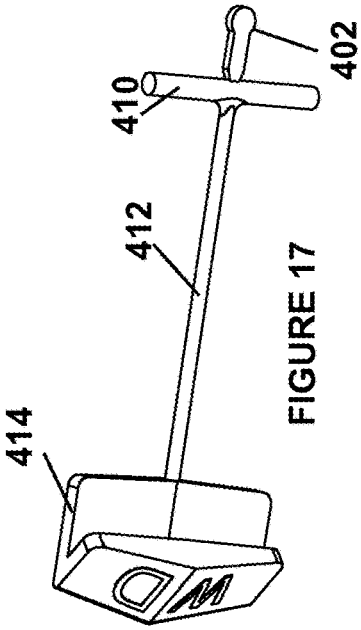
FIG. 17 is a perspective view of a specific example of a flexible tie of plastics material that may be used with the first and third embodiments.
Figure 21:
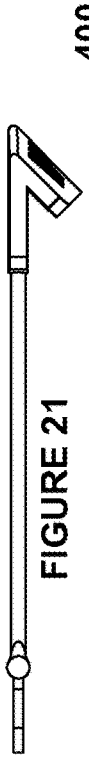
FIG. 21 is a second side view of the flexible tie.
Figure 20:
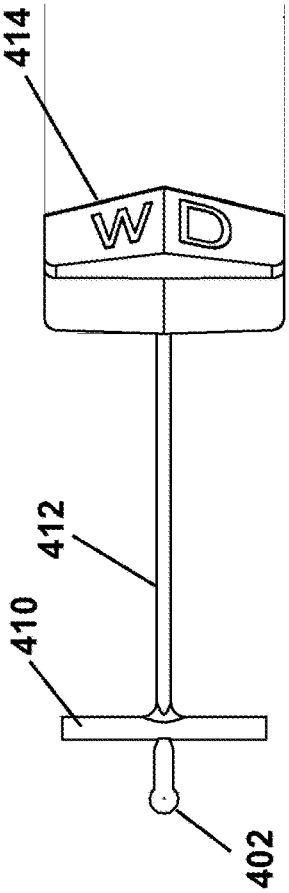
FIG. 20 is a top plan view.
Figure 19:
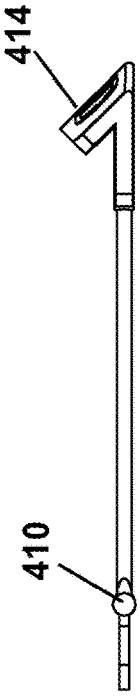
FIG. 19 is a first side view of the flexible tie.
Figure 18:
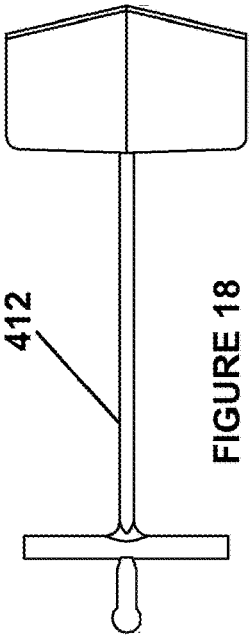
FIG. 18 is a rear plan view of the flexible tie.
Figure 22:
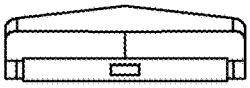
FIG. 22 is a first end view of the flexible tie.

A specific example of a flexible tie 400 which can be used with the first and third embodiments is shown in FIGS. 17 to 23. The flexible tie 400 is connected to a number of other flexible ties by a rail element 402 which can allow a rack of the ties to be loaded on a needle applicator gun (not shown but well known in the retail trade).

The flexible tie 400 comprises a flexible cross bar 410, an elongate flexible element 412 and a large anchor element 414 which is prominent and very visible when the tie is attached with the security tag to an item of merchandise.

It is to be understood that the invention is not limited to the specific details described herein which are given by way of example only and that various modifications and alterations are possible without departing from the scope of this invention as defined in the claims.

The invention claimed is:

1. A security tag for attachment to an item of merchandise, comprising:

a first panel having a first surface, wherein said first panel defines a receptacle that is accessible from said first surface;

a second panel having a second surface and an orifice, accessible from said second surface, that extends through said second panel, wherein said item of merchandise can be selectively positioned between said first panel and said second panel;

a plastic tie having a first end and a second end, wherein said plastic tie extends through said orifice in said second panel, through said item of merchandise, and into said receptacle so that said second end of said plastic tie is protected within said receptacle of said first panel and said plastic tie retains said first panel and said second panel against said item of merchandise, whereby said plastic tie must be broken to separate said first panel and said second panel from said item of merchandise.

2. The security tag according to claim 1, wherein said first panel and said second panel are connected by a hinge.

3. The security tag according to claim 1, wherein said first panel and said second panel are unistructurally formed as a single piece with a flexible hinge disposed between said first panel and said second panel.

4. The security tag according to claim 1, wherein said plastic tie can be injected through said orifice, through said item of merchandise and into said receptacle using a needle applicator tagging gun.

5. The security tag according to claim 1, wherein said plastic tie is coloured with a customized colour that is unique for use with said security tag.

6. The security tag according to claim 1, wherein said first end of said plastic tie terminates with a visually identifiable anchor head that remains visible on said security tag as said plastic tie interconnects said first panel and said second panel.

7. The security tag according to claim 1, wherein said first end of said plastic tie can pivot in said orifice of said second panel.

8. The security tag according to claim 7, wherein said second end of said plastic tie is barbed and mechanically engages said receptacle in said first panel once passed into said receptacle.

9. The security tag according to claim 1, wherein said second panel defines sides for said receptacle and said second panel further includes tabs on said sides to inhibit access to said receptacle through said sides.

10. The security tag according to claim 1, wherein said receptacle is sized to receive and retain said second end of said plastic tie.

11. The security tag according to claim 1, wherein said second end of said flexible tie terminates with a cross bar element and said first end of said receptacle terminates with an anchor element that is larger than said cross bar element.

12. A security tag for attachment to an item of merchandise, comprising:

a first panel having a first surface, wherein said first panel defines a receptacle that is accessible from said first surface;

a second panel having an orifice formed therethrough, wherein said item of merchandise can be selectively positioned between said first panel and said second panel;

a plastic tie having a first end and a second end, wherein said plastic tie extends through said orifice in said second panel, through said item of merchandise, and into said receptacle so that said second end of said plastic tie is protected within said receptacle of said first panel and said receptacle retains said second end of said plastic tie and prevents said second end from being non-destructively retracted out of said receptacle, therein requiring said plastic tie to be broken to separate said first panel and said second panel from said item of merchandise.

13. The security tag according to claim 12, wherein said first panel and said second panel are connected by a hinge.

14. The security tag according to claim 12, wherein said first panel and said second panel are unistructurally formed as a single piece with a flexible hinge disposed between said first panel and said second panel.

15. The security tag according to claim 12, wherein said first end of said plastic tie terminates with a visually identifiable anchor head that remains visible on said security tag as said plastic tie interconnects said first panel and said second panel.

16. A security tag for attachment to an item of merchandise, comprising:

a first panel having a first surface, wherein said first panel defines a receptacle that is accessible from said first surface; and a second panel having an orifice;

a breakable plastic tie extending through said orifice in said second panel, wherein said plastic tie can be advanced through said item of merchandise and into said receptacle of said first panel, wherein said receptacle receives and retains said plastic tie and prevents said plastic tie from being retracted out of said receptacle, therein requiring said plastic tie to be broken to separate said first panel and said second panel from said item of merchandise.

17. The security tag according to claim 16, wherein said first panel and said second panel are connected by a hinge.

18. The security tag according to claim 16, wherein said first panel and said second panel are unistructurally formed as a single piece with a flexible hinge disposed between said first panel and said second panel.

19. The security tag according to claim 16, wherein said plastic tie is unistructurally formed as part of said second panel.

* * * * *